US006505608B2

(12) United States Patent
Hiraku et al.

(10) Patent No.: US 6,505,608 B2
(45) Date of Patent: Jan. 14, 2003

(54) FUEL SUPPLY SYSTEM

(75) Inventors: Kenji Hiraku, Chiyoda (JP); Kenichiro Tokuo, Chiyoda (JP); Tadahiko Nogami, Mito (JP); Kunihiko Takao, Tsuchiura (JP); Hiroyuki Yamada, Hitachinaka (JP); Yukio Takahashi, Hitachinaka (JP); Atsuji Saito, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 30 days.

(21) Appl. No.: 09/812,082

(22) Filed: Mar. 20, 2001

(65) Prior Publication Data

US 2002/0033167 A1 Mar. 21, 2002

(30) Foreign Application Priority Data

Sep. 18, 2000 (JP) ..... 2000-286852

(51) Int. Cl.[7] ..... F02M 37/04; F02M 55/02
(52) U.S. Cl. ..... 123/458; 123/456; 123/467
(58) Field of Search ..... 123/456, 458, 123/467, 447

(56) References Cited

U.S. PATENT DOCUMENTS 5,433,182 A * 7/1995 Augustin et al. ..... 123/456
5,511,528 A * 4/1996 Iwanaga et al. ..... 123/467
5,577,479 A * 11/1996 Popp ..... 123/456 X
5,592,968 A * 1/1997 Nakashima et al. .... 123/456 X
5,752,486 A * 5/1998 Nakashima et al. ..... 123/467
6,401,691 B1 * 1/2002 Kawano et al. ..... 123/456

FOREIGN PATENT DOCUMENTS

JP 11-62775 3/1999

* cited by examiner

*Primary Examiner*—Tony M. Argenbright
(74) *Attorney, Agent, or Firm*—Antonelli, Terry, Stout & Kraus, LLP

(57) ABSTRACT

A fuel supply system for a direct injection engine which has a variable capacity single cylinder plunger pump and two fuel rails. Offices are disposed at the upstream side inlets of both fuel rails, respectively. At the opposite sides to the inlet sides, the fuel rails are interconnected with each other by a connecting pipe. Using this fuel supply system, it is possible to increase a characterisitic frquency of the fuel columns, and to stabilize, suppress, and smooth out pressure pulsation in the fuel rails, thereby reducing uneven fuel injections into the cylinders. The system may have a cam which drives a plunger of a high pressure fuel pump to reciprocate once for every two combustions in two engine cylinders.

6 Claims, 10 Drawing Sheets

* NOTE 1 : T.D.C means "Top Dead Center"
* NOTE 2 : B.D.C means "Bottom Dead Center"

FUEL SUPPLY SYSTEM

BACKGROUND OF THE INVENTION

The present invention relates to a fuel supply system for a direct injection engine in which fuel is injected directly into cylinders of the engine.

A known fuel supply system of an engine having two cylinder arrays, such as a V-type or Horizontal Opposed Type engine, as disclosed in JP-A11-62775, comprises:

- a first and a second delivery pipes for distributing fuel (hereinafter also referred to as fuel rails) connected to fuel injection valves (hereinafter referred to as injector) of cylinders in the respective cylinder arrays;
- a fuel pump connected to the first delivery pipe at an upstream end thereof;
- a connecting pipe connecting the downstream end of the first delivery pipe and the upstream end of the second delivery pipe;
- a regulator (means for regulating the fuel pressure) connected to the downstream end of the second delivery pipe; and
- a pressure wave transmission means interposed between the upstream end of the first delivery pipe and the downstream end of the second delivery pipe for transmitting pressure waves therebetween.

The pressure wave transmission means is used to reduce the amplitudes of pressure waves which propagate through a fuel supply line and reflected waves as well, and relieve a pressure difference between the far-most parts of the upstream end of the first delivery pipe and the downstream end of the second delivery pipe, thereby reducing uneven fuel injections (in amount) between the cylinder arrays.

In recent years, a fuel injection system has been in the spotlight, by which fuel is injected directly into cylinders of an automobile engine for improving a mileage. The fuel injection system is provided with a fuel pump for further pressurizing fuel in order to directly inject fuel into cylinders under a high pressure.

The known fuel pump mentioned above has a fixed capacity to discharge an excessive amount of fuel than that actually injected from injectors and so constructed that superfluous fuel is returned by the regulator back to the low pressure side of the fuel rail thereby maintaining the pressure in the fuel rails at a substantially constant level.

A fuel supply system having such a fixed-capacity fuel pump disadvantageously lowers the fuel economy of the engine due to the fact that it imposes an extra work on the pump. Consequently, from the viewpoint of fuel economy, a fuel pump having a variable capacity mechanism is preferred. In the fuel supply system with a variable-capacity fuel pump, since the fuel pump is capable of discharging an exact amount of fuel needed by injectors, it may cut wasteful fuel injection and hence wasteful energy consumption. In addition, the variable-capacity fuel pump can advantageously maintain a substantially constant pressure in the fuel rails without utilization of a regulator.

With regard to the fuel supply system having the fixed-capacity fuel pump, since it has the regulator and a return pipe, it is inapplicable or improper to apply to a return-less piping arrangement without a regulator and a return pipe when the variable-capacity fuel pump is used.

Incidentally, the variable-capacity fuel pump is preferably of a single cylinder plunger type since a variable-capacity mechanism can be constructed simply so as to be of a low manufacturing cost. However, it should be noted that the single cylinder plunger pump entails appreciable pressure pulsation in the discharged fuel because the pump operates intermittently with regard to suction and discharge of fuel.

In general, since the fuel pump is driven by the rotational power of engine, the pressure of fuel discharged from the pump pulsates in the fuel rails in synchronism with the engine. On the other hand the injectors connected to the fuel rails are adapted to inject fuel synchronously with the engine. Hence, in order to ensure fuel injections to be in phase with the pressure of the fuel discharged, it is desirable to synchronize the injectors with the pump. This is the case particularly when a single single cylinder plunger pump is utilized, because it generates relatively large fuel pressure pulsation and a little difference in phase between fuel injection and fuel discharge has a significant influence on the amount of the fuel injected by the injectors. It is therefore necessary to adjust the injection timing so as to be in phase with the pump discharge such that the pump discharges fuel once for every two fuel injections by the injectors for two cylinders.

Ideally and preferably, the pump discharges once for every injection by one injector for perfect synchronization. This implies, however, that, given a maximum rotational speed of 8000 rpm for a V-type six-cylinders engine for example, the number of cycles of the reciprocal plunger must be 400 cycles per second, which seems difficult to attain in view of its durability, dimensional limitation, efficiency and other factors of the pump. The difficulty will be amplified for V-type eight and V-type ten cylinders engines.

For these reasons, an acceptable pumping rate for the plunger pump to provide well balanced fueling without suffering from an overload is one time discharge from the pump for injections to two cylinders. This timing, however, has a drawback that the injectors are divided into two groups one of which performs injections during suction strokes of the pump and the other of which performs injections during discharge strokes of the pump, resulting in uneven injections of fuel between the two injector groups.

Furthermore, in V-type six engines for example, because the injection order between two cylinder arrays is alternate, the injectors are completely distinguished to two groups, one of which performs injections during suction strokes of the pump and the other of which performs injections during discharge strokes of the pump, between two fuel rails resulting in enhanced uneven fuel injection therebetween.

SUMMARY OF THE INVENTION

Thus, an object of the invention is to provide a fuel supply system for use with direct injection engine, which can reduce the pressure pulsation in fuel rails thereby reducing a variance of fuel injections among engine cylinders.

According to a first aspect of the invention, there is provided a fuel supply system for an engine having a first and a second opposed cylinder arrays each equipped with a fuel injection valve (injector) for injecting fuel thereinto, wherein the fuel supply system comprises:

- a low pressure pump for transferring fuel from a fuel tank;
- a fuel pump which pressurizes fuel fed from the low pressure pump and comprises a single plunger operating to reciprocate synchronously with the engine;
- a first and a second fuel rails provided in association with the first and the second cylinder arrays, respectively;
- a pipe line which leads off from the fuel pump, is diverged to two pipe lines and connected to the first and the second fuel rails; and a first and a second orifices interposed in the pipe line.

According to a second aspect of the invention, there is provided a fuel supply system for an engine having a first and a second opposed cylinder arrays each equipped with a fuel injection valve (injector) for injecting fuel thereinto, wherein the fuel supply system comprises:

a low pressure pump for transferring fuel from a fuel tank;

a fuel pump which pressurizes fuel fed from the low pressure pump and comprises a single plunger operating to reciprocate synchronously with the engine;

a first and a second fuel rails provided in association with the first and the second cylinder arrays, respectively;

a pipe line which leads off from the fuel pump, is diverged to two pipe lines and connected to the first and the second fuel rails;

a first and a second orifices interposed in the pipe line; and a connecting pipe for interconnecting the first and the second fuel rails with each other at the opposite side ends of the fuel rails to the fuel pump.

Preferably the high pressure pump has a drive mechanism which comprises a rotational power source rotating at one half the rotational speed of the engine shaft like as a camshaft of the engine and a cam for converting the rotational power into the reciprocal motion of the plunger, wherein one rotational motion of the camshaft causes the plunger to reciprocate by one half the number of the combustion cylinders.

DESCRIPTION OF THE EMBODIMENTS

A variable capacity fuel pump of the invention will now be described by way of example with reference to accompanying drawings.

Figure 1A:
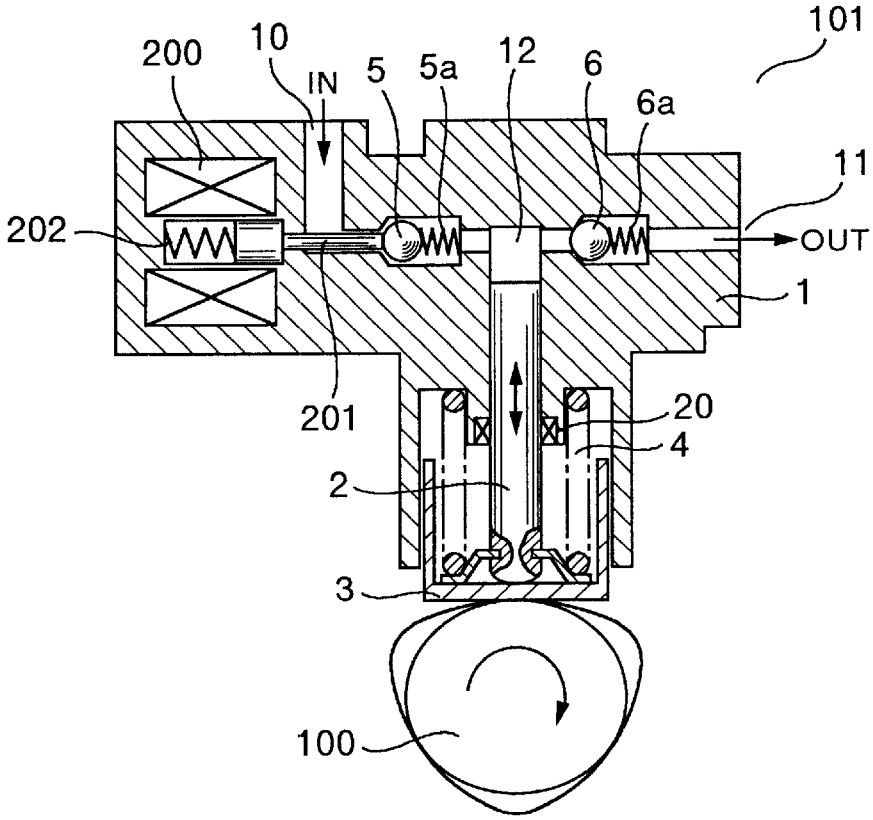
FIG. 1A shows a longitudinal cross sectional view of a variable capacity fuel pump for pressurizing the fuel, for use in a fuel supply system of the invention.

Referring to FIG. 1A, there is shown a variable capacity fuel pump having a pump body 1 which includes a fuel suction passage 10, a fuel discharging passage 11, and a pump room 12.

Arranged in the pump room 12 is a pressurizing member or a plunger 2 slidably supported by a cam 100. A lifter 3 is always in contact with the cam profile of the cam 100 and supports the lower end of a spring 4 and the proximal end of the plunger 2. Numeral 20 denotes a seal member for sealing the plunger 2 and the pump room 12 of the pump body 1. Provided in the suction passage 10 and in the discharging passage 11 are a suction valve 5 and a discharge valve 6, respectively, in forced abutment against respective washers by means of springs 5*a* and 6*a*, respectively, so that they act as check valves for limiting the flows of the fuel through the passages in one direction.

200 denotes a solenoid mounted in the pump body 1. The solenoid 200 is provided with an engagement member 201 and a spring 202. The engagement member 201 is biased by the spring 202 in a direction to open the suction valve 5 when the solenoid is de-energized. The biasing force of the spring 202 is greater than that of the spring 5*a* of the suction valve 5, so that the suction valve 5 is disengaged from the washer to open the valve, as shown in FIG. 1A. On the other hand , when the solenoid 200 is energized, the suction valve 5 is pulled to its close position by the solenoid against the biasing force of the spring 202, but facilitated by the biasing force of the spring 5*a*.

The pump 1 equipped with these elements will be generally referred to as high pressure fuel pump 101.

Figure 1B:
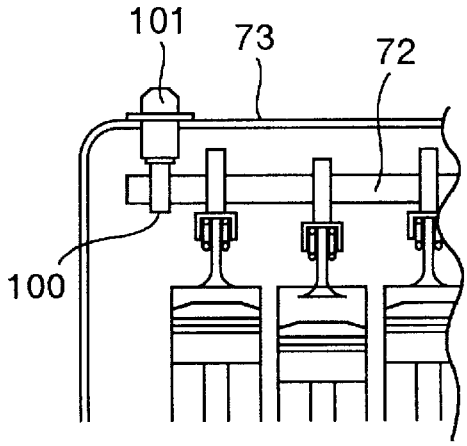
FIG. 1B shows a partial cross sectional view of the variable capacity fuel pump shown in FIG. 1A.

In FIG. 1B, 73 denotes a cover of an engine 71 for accommodating therein such elements as pistons and engine cams. 72 denotes an engine cam shaft with which the cam 100 is directly coupled. The high pressure fuel pump 101 is mounted on the engine cover 73.

The rotational motion of the cam 100 caused by the rotation of the engine cam shaft 72 results in vertical reciprocal movements of the plunger 2. This type of high pressure fuel pump is called single cylinder plunger pump.

The operation of this type of high pressure fuel pump 101 will now be described.

The lifter 3 provided at the lower end of the plunger 2 is in forced contact with the cam 100 by the action of the spring 4. The plunger 2 changes the internal volume of the pump room 12 as it is reciprocated by the rotating cam 100, which is driven by, for example, the engine cam shaft.

Figure 2:
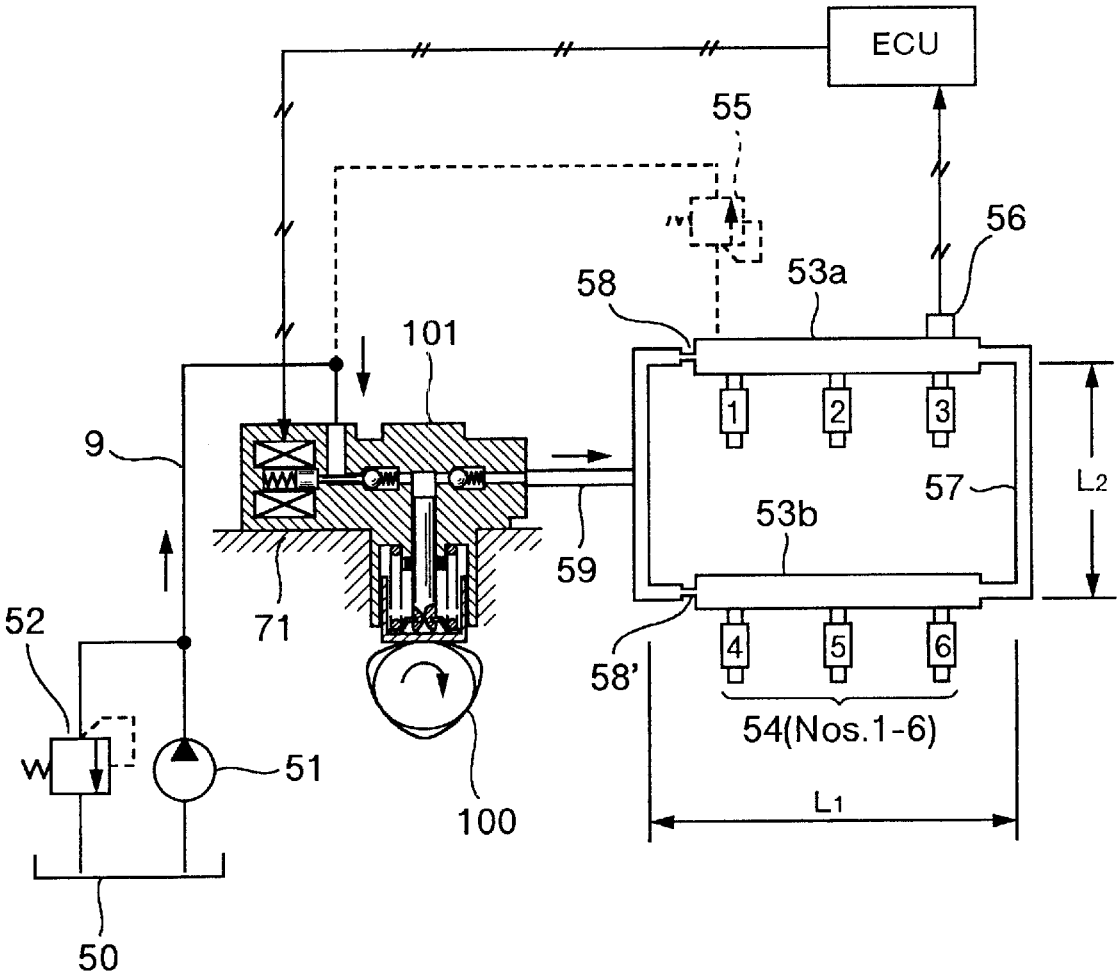
FIG. 2 shows one embodiment of a fuel supply system according to the invention.

As the suction valve 5 is closed during a discharge stroke of the plunger 2, the fuel pressure in the pump room 12 increases until the discharge valve 6 is opened by that pressure to supply the pressurized fuel to the fuel rails 53*a* and 53*b* as shown in FIG. 2.

The suction valve 5 is automatically opened as the pressure in the pump room 12 becomes lower than that in the fuel intake port of the pressuring chamber 12. The suction valve 5 is closed when the solenoid 200 is energized.

The energizing of the solenoid 200 will create an electromagnetic force to attract the engaging member 201 towards the solenoid, overcoming the biasing force of the spring 202. As a result, the engaging member 201 is disengaged from the suction valve 5, thereby allowing the suction valve 5 to seat on the washer and close the passage under the biasing force of the spring 5*a*.

Thus, during each discharging stroke, the suction valve 5 is closed to ensure discharging of the fuel that amounts to a decreased volume of the pump room 12 into the fuel rails 53*a* and 53*b* under pressure through the discharge valve 6 opened.

On the other hand, when the solenoid 200 is de-energized, the engaging member 201 is forced to push the suction valve 5 by the biasing force of the spring 202, thereby opening the suction valve 5. Thus, during discharge strokes, the pump room 12 is maintained at substantially the same low pressure as in the fuel intake port, leaving the discharge valve 6 closed. Consequently, a volume (amount) of the fuel corresponding to the decrease in volume of the pump room 12 will be returned from the chamber 12 to the fuel intake port through the suction valve 5.

When the solenoid 200 is energized during a discharge process, the pressurized fuel starts to flow into the fuel rails 53*a* and 53*b*. Thereafter the pressure in the pump room 12 is increased, so that the suction valve 5 remains closed if the solenoid 200 is de-energized. The suction valve 5 will be automatically opened at the beginning of the suction stroke. Thus, the amount of fuel to be discharged may be adjusted by adjusting the timing of the solenoid 200.

FIG. 2 is a schematic diagram showing the structure of a fuel supply system utilizing a high pressure fuel pump according to the invention.

As shown in FIG. 2, fuel is led from a fuel tank 50 to the fuel intake port of the high pressure pump 101 via a low pressure conduit 9 by a low pressure pump 51. The fuel is maintained led at a constant pressure by a pressure regulator 52 while it is led to the pump. Subsequently, the fuel is pressurized by the high pressure pump 101 and discharged therefrom through the fuel discharge port thereof to the fuel rails 53*a* and 53*b*.

The fuel rails 53*a* and 53*b* are provided with a plurality of injectors 54 one for each combustion cylinder, a relief valve 55, and a pressure sensor 56. The injectors 54 inject fuel under the control of an engine control unit (ECU). In the example shown herein, six injectors numbered 1 through 6 are provided.

The relief valve 55 will not be opened under normal operating conditions, but will be opened when the fuel pressure in the fuel rails 53*a* and 53*b* exceeds a predetermined level to thereby prevent destruction of the pipes involved by the excessive pressure. The relief valve 55 need not necessarily be connected to the fuel rails 53*a* and/or 53*b* as indicated by a phantom line: it can alternatively be connected to a fuel delivery conduit 59.

The pump 101 maintains the fuel pressure in the fuel rails 53*a* and 53*b* at substantially a constant level by obtaining an optimum discharge timing as calculated by the ECU based on the signal received from the pressure sensor 56 to control the solenoid 200.

Thus, the invention permits use of a return-less piping arrangement which requires no return pipe connected to a low pressure line, since the pressure in the fuel rails can be maintain at a desired level without any regulator according to the invention. The return-less piping arrangement eliminates back-flows of the hot fuel heated by the engine into the tank 50, so that it may advantageously suppress generation of fuel vapor in the tank 50.

It will be understood from the description given above, the high pressure fuel pump 101 is a variable capacity pump capable of controlling the amount of fuel to be discharged by means of the solenoid 200.

The variable capacity pump shown above is a single cylinder type plunger pump having a single plunger 2 for pumping, which is simple in structure, yet capable of varying its capacity. However, it poses a problem that it results in amplified pressure pulsation in the fuel rails 53*a* and 53*b*, which are likely to generate uneven discharges of fuel.

In order to alleviate this problem, the invention provides the cam 100 of a fuel supply system for use with a V-6 (i.e. V-type six cylinders) engine for example. As shown in FIG. 2 the cam 100 has a generally triangular configuration having three ridges for reciprocating the plunger three times per one revolution of the cam 100 when rotated by the engine cam shaft 72.

Thus, the plunger reciprocates once for every two fuel injections by two injectors 54 for two cylinders while keeping the injectors in phase with the pressure pulsation in the fuel rails 53*a* and 53*b*, i.e. keeping them synchronized with each other. When the pressure pulsation is great, pressures of the fuel injected by the respective injectors 54 can be higher or lower than a prescribed level depending on the timings of the injectors 54. Thus, unless the injectors are well synchronized with the plunger, the fuel pressures in the respective injectors, and hence the amounts of the fuel injected thereby, can differ from one injector to another in every injection stroke if the opening times of the valves are the same.

Figure 3:
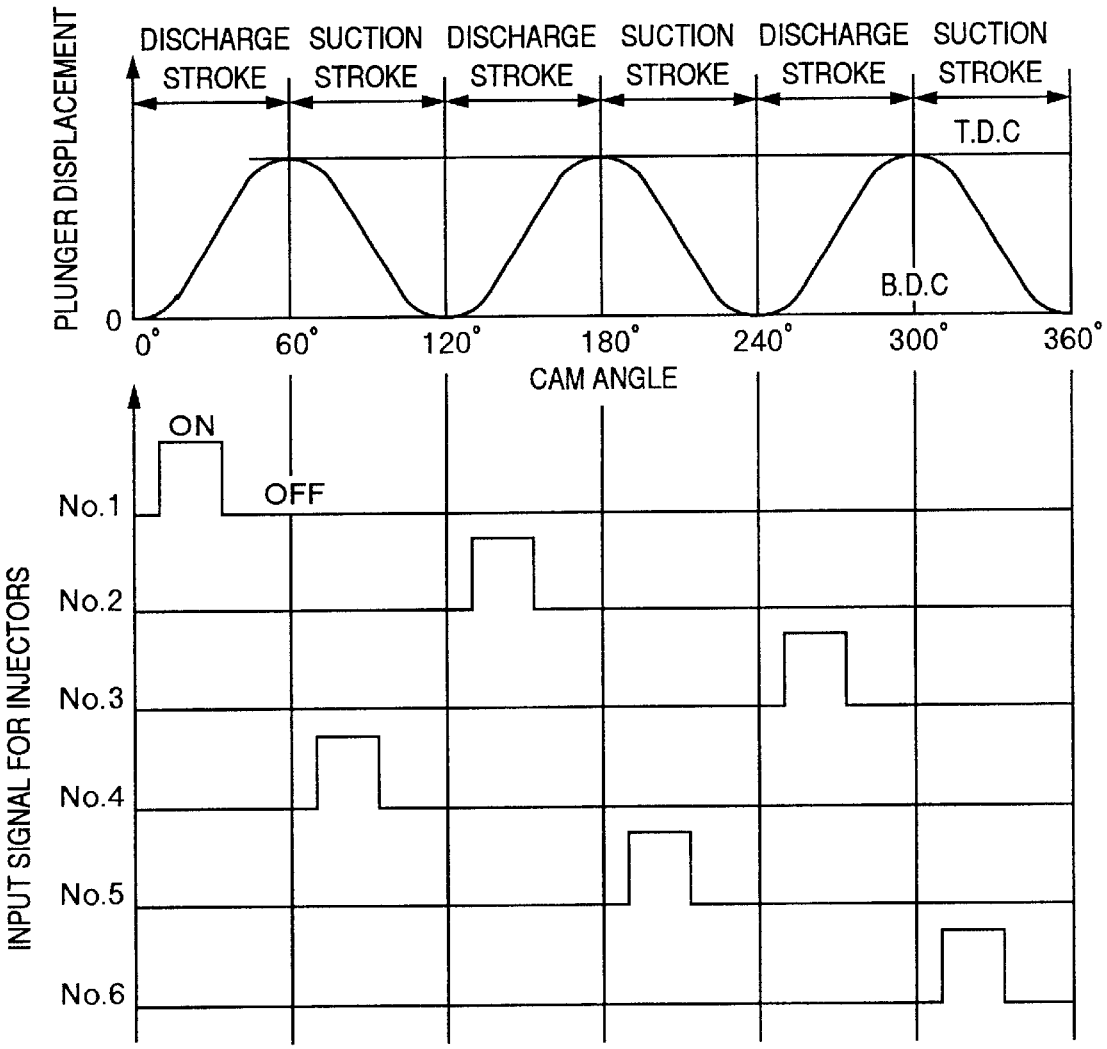
FIG. 3 shows a relationship between the displacement of the plunger and the plunger signal supplied to the injector.

FIG. 3 shows the displacement of a plunger, as arranged in a manner described above, as a function of time, along with a timing chart of an injector signal supplied to the injectors.

The abscissa indicates the angle of rotation of the cam 100. Each revolution (through 360°) of the cam 100 causes the plunger to reciprocate three times, during which the engine undergoes two cycles. Each of the combustion cylinders of a typical four-cycle engine performs combustion once for every two engine cycles, so that each of the six injectors injects fuel once for every revolution of the cam 100.

Although the plunger is displaced in synchronism with the timed injections on account of its structure, some of the injectors perform injections in the discharging strokes and the rest perform injections in the suction strokes. Thus, the two groups of the injectors tend to discharge uneven amounts of fuel. Furthermore, numbering the injectors of the V-6 engine as No. 1 to No. 6 as shown in FIG. 2, the injections alternate in the two separate arrays of cylinders, proceeding with the injectors Nos. 1, 4, 2, 5, 3 and 6 in the order mentioned and shown in FIG. 3. This implies that the injectors are completely divided into two separate groups in such a way that one group connected with one fuel rail performs injection in the discharging strokes and the other group connected with the other fuel rail performs injection in the suction strokes, thereby undesirably promoting the uneven injection of fuel through the two fuel rails.

In other words, if the injectors Nos. 1, 2 and 3 connected to the fuel rail 53*a* perform injections during discharge strokes of the pump, the injectors Nos. 4, 5 and 6 connected with the fuel rail 3*b* perform injections during the suction strokes, resulting in a distinct difference in pulsating fuel pressures in the two fuel rails. This in turn results in a great imbalance in the amounts of fuel injected by the injectors Nos. 1 to 6.

In order to avoid such imbalance or unevenness of fuel injections, the pump is ideally operated to discharge once for each fuel injection by the injectors in turn, which can be attained by a cam having six ridges for example for reciprocating the plunger six times per one revolution of the cam.

However, if one assumes that the maximum rotational speed of the engine is 8,000 rpm, the frequency of the plunger undergoing the reciprocal movements will reach 400 cycles per second, which is extremely difficult to attain in view of the permissible durability, size, and efficiency as well as other factors. In the cases of V-8 and V-10 engines, cams must have 8 and 10 ridges, respectively, so that the cams must be very large, and in addition the speeds of the plunger in reciprocal motion must be further increased. Therefore, use of such cams becomes increasingly difficult.

Cavitation, i.e. generation of cavities, is a serious problem that is encountered when the suction pressure decreases at a high plunger speed. If cavitation once occurs, it causes serious degradation of the volumetric efficiency of the pump and greatly destroys its durability. The pump is therefore required to have additional components such as dampers to suppress cavitation, which inevitably makes the pump larger and costly accordingly.

For the reasons described above, the pump of the fuel supply system of the invention is designed to perform one discharge per two fuel injections for two cylinders, thereby lowering the frequency of the reciprocal plunger and hence achieving a compact, cost-effective, and efficient pump; nevertheless the aforementioned problem of uneven fuel injections by the injectors remain unsolved.

Therefore, in order to alleviate this problem, the invention provides: a fuel delivery conduit 59 which has one end connected to the discharge port of the high pressure pump 101 and has two bifurcated ends connected to the respective upstream ends of the two fuel rails 53*a* and 53*b* via two orifices 58 and 58', respectively; and a connecting pipe 57 connecting together the two downstream ends of the fuel rails 53*a* and 53*b*, as shown in FIG. 2.

Figure 4:
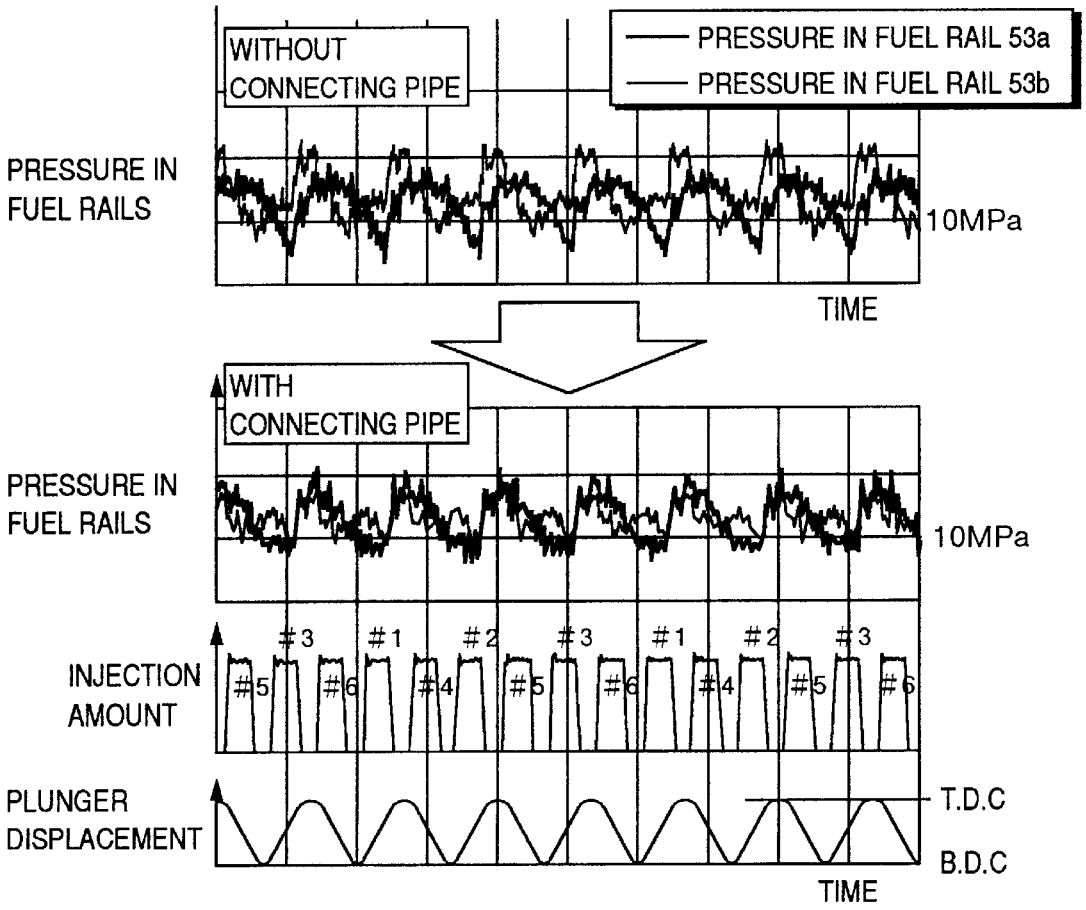
FIG. 4 is a graphical representation showing the effect of a connecting pipe of the fuel supply system according to the invention.
Figure 5:
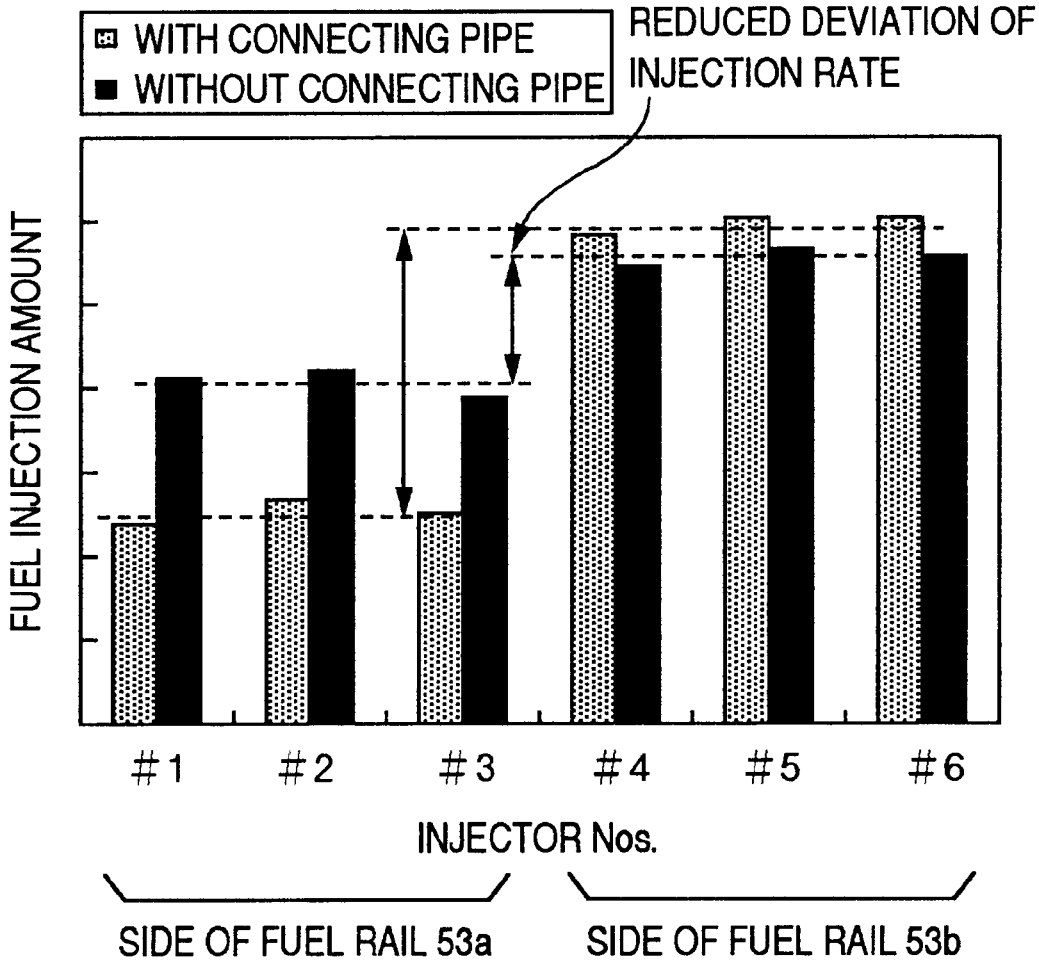
FIG. 5 is another graphical representation showing the effect of a connecting pipe of the fuel supply system according to the invention.

FIGS. 4 and 5 show the effects of the connecting pipe 57. Waveforms shown in FIG. 4 represent the fuel pressures in the fuel rails as a function of time for cases with and without the connecting pipe 57.

In FIG. 4, the amounts of fuel injected by the respective injectors are also shown for informative reference along with the displacement of the plunger as a function of time.

It is seen from FIG. 4 that without the connecting pipe a distinct difference exists between the pressure in the fuel rail 53*a* (shown by a thick curve line) and the pressure in the fuel rail 53*b* (shown by a thin curve line), and between their average pressures as well, so that there exist uneven fuel injections between the two groups of injectors associated with the respective fuel rails.

As discussed above, the pressure difference is due to the injectors of the two separate groups connected with the fuel rails 53*a* and 53*b* to operate in the discharge strokes and the suction strokes, or vise versa, of the pump, respectively. In contrast, if the connecting pipe exists, it is seen that the pulsating fuel pressures in the two fuel rails are smoothed out, thereby exhibiting similar pressure waveforms, and hence similar average pressures, in the two fuel rails.

FIG. 5 shows the amounts of fuel injected by the respective injectors with and without the connecting pipe.

FIG. 5 shows the difference between the amounts of fuel injected by the injectors Nos. 1, 2, and 3 connected with the fuel rail 53*a*, and the amounts injected by the injectors Nos. 4, 5, and 6 connected with the fuel rail 53*b*, with and without a connecting pipe 57. It is seen in the figure that the difference can be greatly reduced by the connecting pipe 57.

In other words, the connecting pipe 57 connecting the downstream ends of the two fuel rails smoothes the pressure pulsation in the two fuel rails and reduces the otherwise promoted uneven fuel injections by the separate groups of injectors.

It is noted, however, that although the connecting pipe can smooth the pulsating pressures in the two fuel rails, the connecting pipe is hardly effective in reducing the amplitude itself of the pulsation in each fuel rail, so that the connecting pipe alone cannot be an ultimate solution for the single cylinder plunger pump exhibiting a large pressure pulsation.

Further arrangements other than the one shown in FIG. 2 to suppress the amplitude of the pressure pulsation itself will be described with reference to FIGS. 6 to 8.

The invention utilizes orifices to reduce the pressure pulsation in the fuel supply system, as described above. It should be kept in mind, however, that in order to obtain desired effect of these orifices, and to make the arrangement applicable to the single cylinder plunger pump, the numbers and the positions of the orifices must be determined carefully in a properly designed pipe arrangement, as discussed in detail below.

Figure 6:
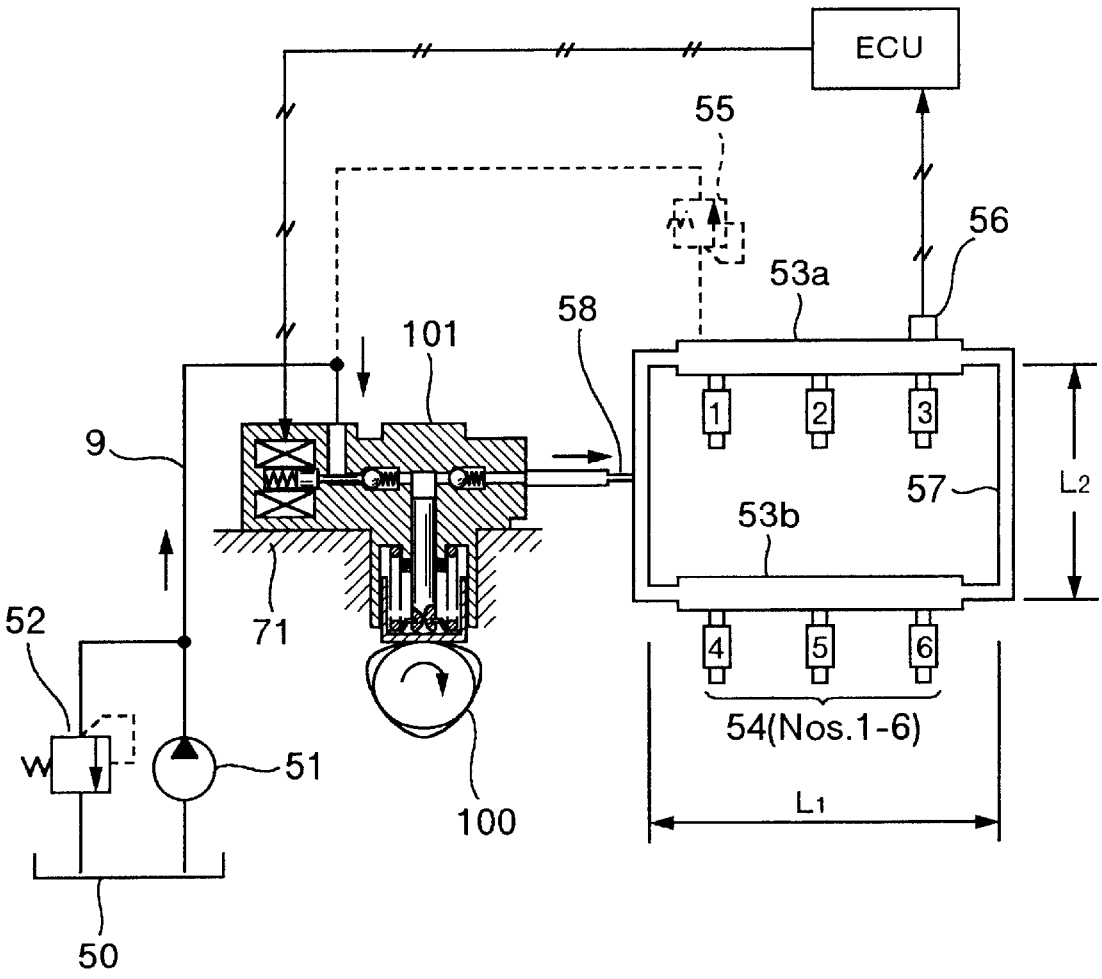
FIG. 6 shows a fuel supply system as a comparative example distinguished from the invention.
Figure 7:
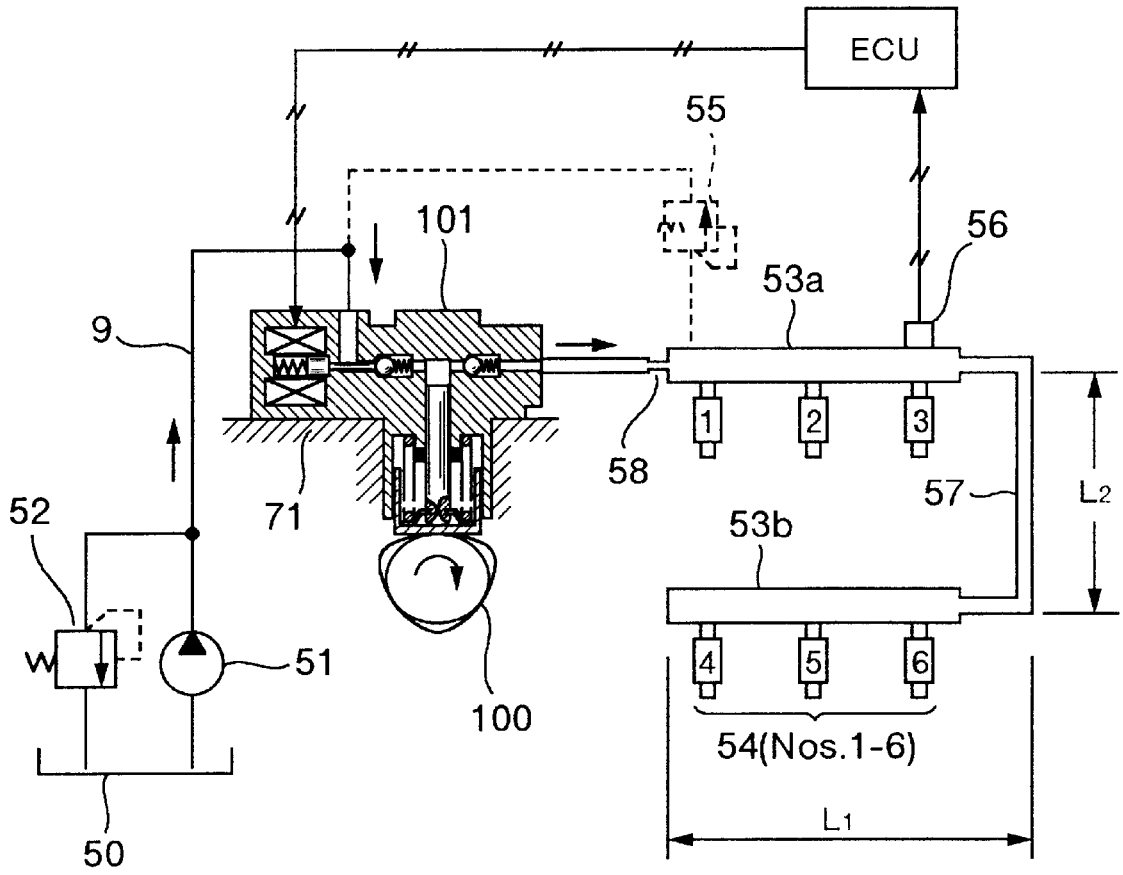
FIG. 7 shows another fuel supply system as a comparative example distinguished from the invention.
Figure 8:
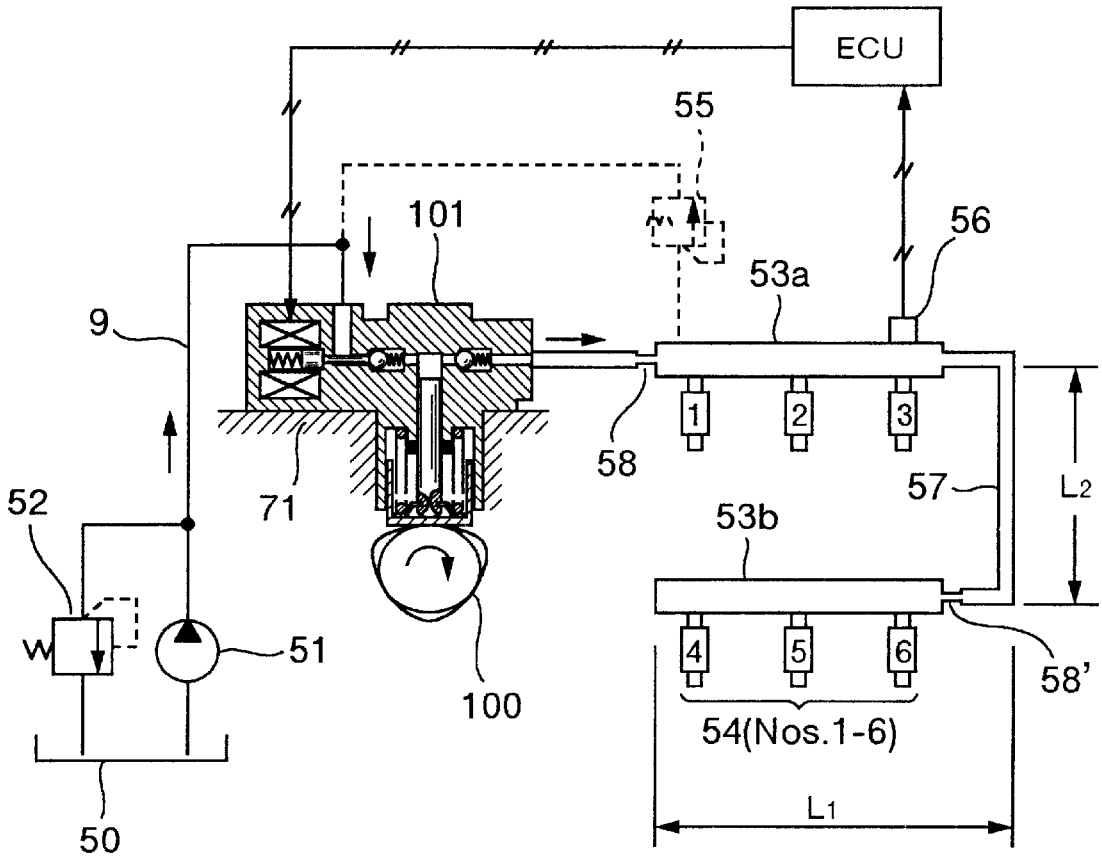
FIG. 8 shows a still another fuel supply system as a comparative example distinguished from the invention.

Referring to FIGS. 6 through 8, there are shown exemplary pipe arrangements useful in understanding the invention. FIG. 6 depicts an arrangement in which a single orifice 58 is provided; FIG. 7, an arrangement in which two fuel rails 53*a* and 53*b* are connected in series and provided with a single orifice 58; and FIG. 8, an arrangement in which a further orifice 58' is added to the series pipe arrangement of FIG. 7.

Figure 9A:
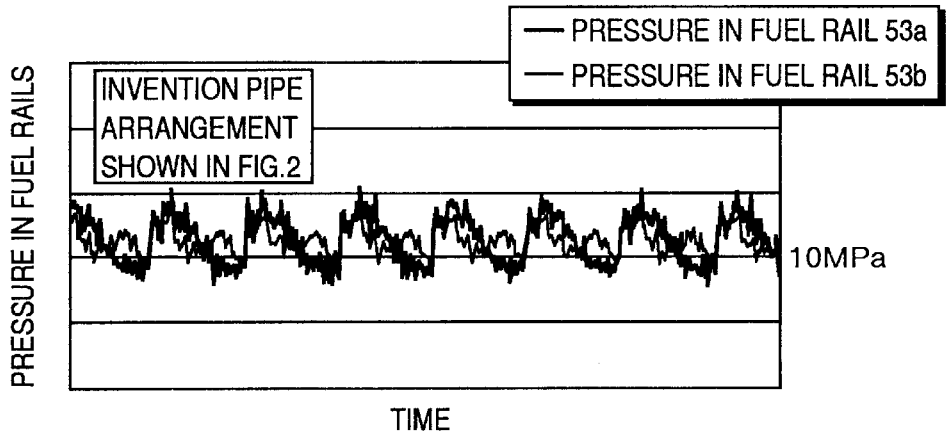
FIG. 9A is a graphical representation of pulsation of fuel pressure in the invention pipe arrangement shown in FIG. 2.
Figure 9B:
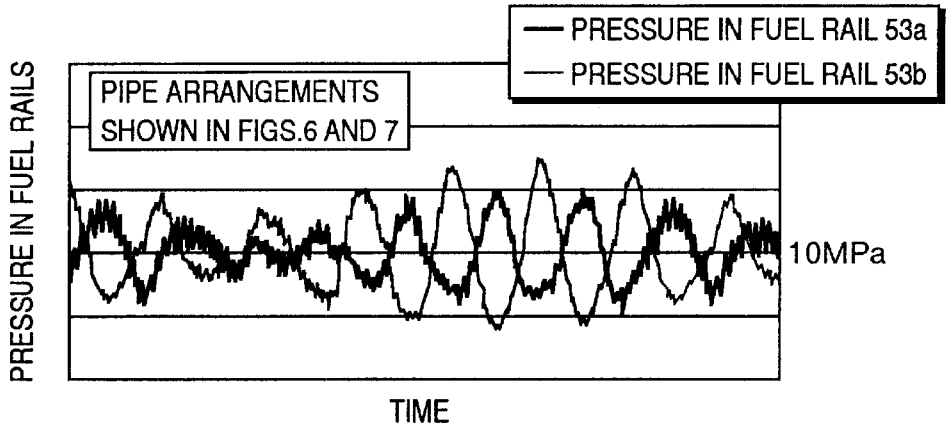
FIG. 9B is another graphical representation of pulsation of fuel pressure in the pipe arrangements shown in FIGS. 6 and 7.

FIGS. 9A and 9B show the pressure pulsation in the fuel rails for the three arrangements shown in FIGS. 6 through 8, to be compared with the pressure pulsation observed in the fuel supply system of the invention shown in FIG. 2.

Referring to FIG. 9B for the arrangements shown in FIGS. 6 and 7, unstable pulsating pressures can be observed, which exhibit beat-like fluctuations and have greater amplitudes than that observed in FIG. 2 (for the invention). Such instabilities occur in the pipe arrangements because the frequencies of fuel pulsation generated by fuel discharged from the fuel pump and the fuel injection from the injectors are close to the low characteristic frequencies of oscillation of the fuel columns in the pipe arrangement thereby causing resonance, and because the fuel columns have the low characteristic frequencies which cause existence of the resonance frequencies within the usual engine speed range.

The reason for such low characteristic frequency of the fuel column in each of the pipe arrangements shown in FIGS. 6 and 7 is that there is essentially no fluid restrictors nor orifices giving significant fluid resistance in the fuel rail 53*a*, the connecting pipe, and the fuel rail 53*b*. As a result, the length of the fuel column is as long as $2 \times L1 + L2$, where L1 is the length of the fuel rail, and L2 is the length of the connecting pipe.

In contrast, the pipe arrangement of the invention shown in FIG. 2 has resistive orifices in the two fuel rails, which orifices become the nodes of the fuel oscillations, thereby permitting only a high characteristic frequency.

As shown in FIG. 2, with the orifices 58 and 58' serving as the nodes, the free length of the fuel column is not more than L1 and L2. Accordingly, the resultant characteristic frequency of the fuel oscillations is sufficiently high to avoid fuel pressure instabilities such as beats or resonance of the fuel oscillations with the pulsation of the fuel pressure, within the frequency region of normal operating conditions of an engine.

Since the connecting pipe 57 connects the two fuel rails 53*a* and 53*b* without any fluid resistance, it might be thought that the free length of the fuel column is sufficiently long to establish a low characteristic frequency. However, it should be noted that in the invention a return-less pipe arrangement is used in conjunction with the variable capacity pump, so that practically all the fuel discharged by the high pressure pump 101 will be injected into the cylinders by the injectors. As a result, practically no fuel flow will take place through the connecting pipe.

It would be understood that the fuel column in the connecting pipe, immobilized therein, does not unite the two fuel columns in the fuel rail 53*a* and 53*b* together, and hence that the connecting pipe will not induces a low characteristic frequency as mentioned above.

Figure 9C:
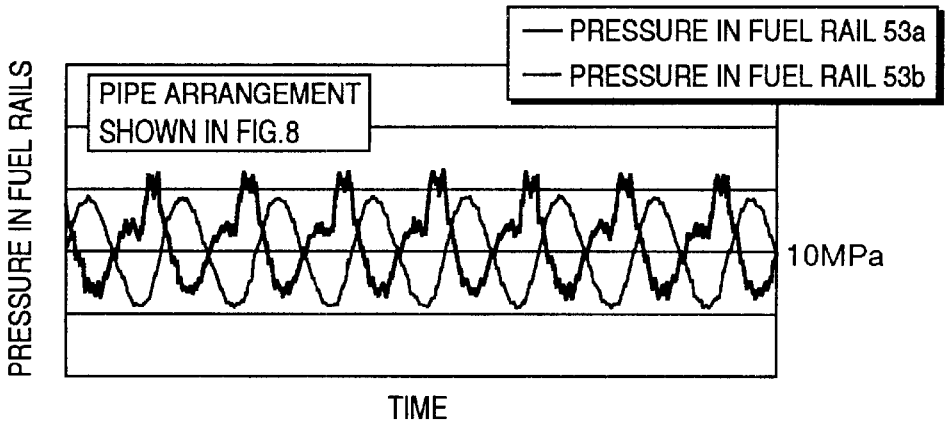
FIG. 9C is a further graphical representation of pulsation of fuel pressure in the pipe arrangements shown in FIG. 8.

It is also noted that in the pipe arrangement shown in FIG. 8 the orifice 58' is added to the arrangement of FIG. 7, which orifice serves as an additional node reducing the free length of the fuel column to L1+L2, thereby increasing the fundamental characteristic frequency accordingly. Consequently, the pressure pulsation is stabilized as shown in FIG. 9C. However, due to a pressure loss caused by the orifice 58', the average fuel pressure is disadvantageously lowered in the fuel rail 53*b* than in the fuel rail 53*a*, which unavoidably results in an unevenness in fuel injection between the two fuel rails.

Further, a large phase difference between the two pressure waves in the respective fuel rails, arising from a delay in propagation of the pressure across the connecting pipe and from the resistive effect of the orifice 58', is a significant factor contributing to the unevenness of fuel injection.

To overcome the limitations and problems mentioned above, the present invention employs a return-less pipe arrangement which includes in combination two parallel fuel rails connected with each other, two orifices connected with the two fuel rails, and a variable capacity pump. Thus, the invention successfully utilizes a single cylinder plunger pump having a variable capacity for the first time in a fuel supply system for internal combustion engines, the fuel supply system capable of reducing pressure pulsation in the fuel rails and hence reducing uneven fuel injections into the combustion cylinders.

Although the invention has been described with particular reference to a preferred embodiment in which the pump is adapted to discharge once for every two fuel injections for two cylinders, variations and modifications of the invention can be effected within the scope of the invention. For example, the pump may discharge once for every three fuel injections for three cylinders. In this instance, the fuel rails need not be connected by a connecting pipe to smooth out the fuel pressures in the fuel rails, so that no connecting pipe is needed, because in this instance neither of injectors that perform injections in the discharge strokes of the pump or injectors that perform injections in the suction strokes belong to a unique fuel rail.

There may be cases where the engine room layout prohibits the use of a connecting pipe. In such cases, however, by connecting the fuel rails with the fuel pump in parallel and by setting up two orifices in the fuel rails as described above, the pressure pulsation can be still suppressed without a connecting pipe to a level at which resultant unevenness in fuel injection does not matter under normal operating conditions of the engine.

Although the invention has been described with particular reference to V-type engines, it would be apparent that the invention may be applied equally well to straight type engines.

Figure 10:
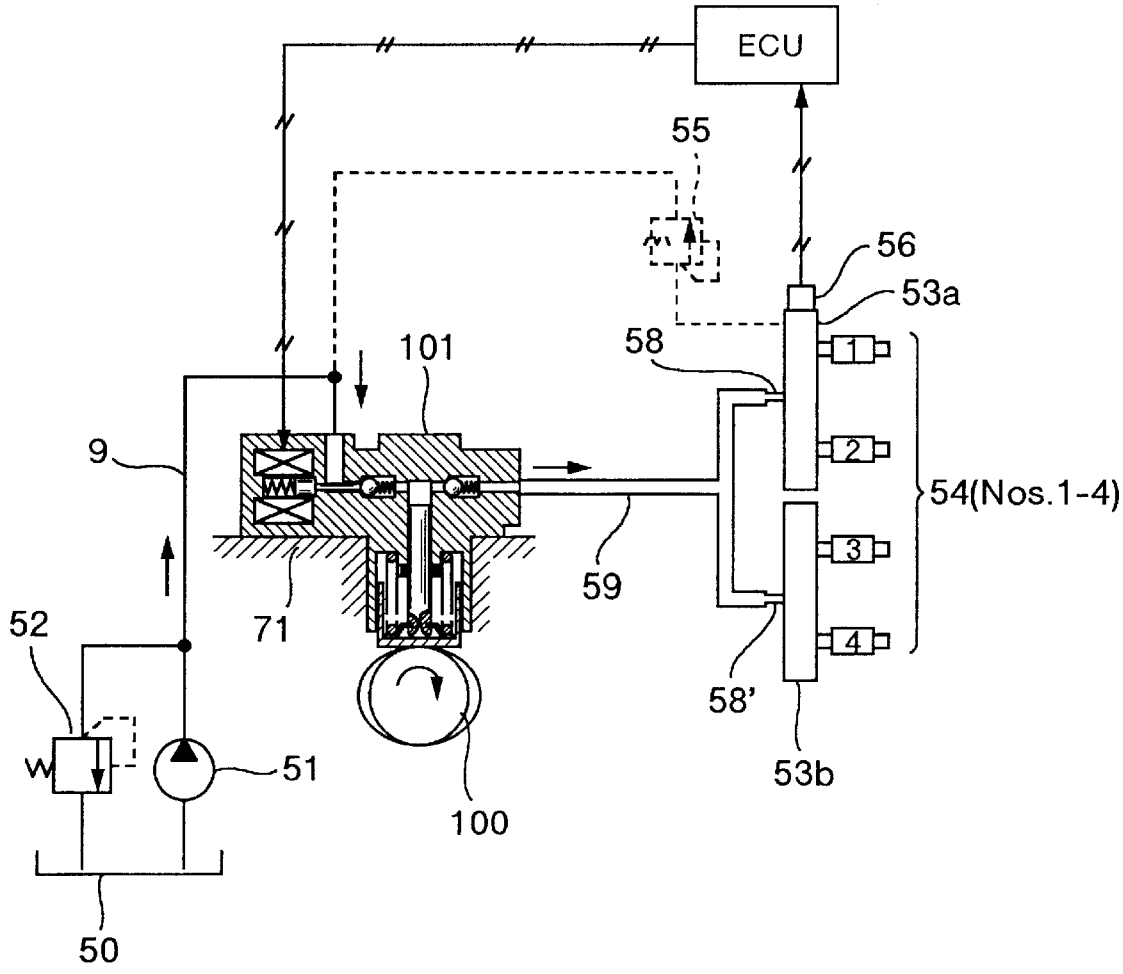
FIG. 10 shows another embodiment of the fuel supply system of the invention.

For example, in a four-cylinder engine as shown in FIG. 10, two separate fuel rails 53 and 53' and two orifices 58 and 58' at the upstream ends of the two fuel rails 53 and 53' may be provided in the same manner as described in connection with V-6 engines. Provision of such separate fuel rails will shorten the free lengths of the fuel columns involved and make the characteristic frequencies of the fuel columns high to an extent that fluid instabilities such as pressure surges and beats due to resonance can be avoided even under a high speed operation of the engine. This feature is particularly effectual in high-speed engines such as sport car engines.

Incidentally, in order to simplify the arrangement of the fuel supply system of the invention, the cam 100 may be mounted on the engine cam shaft 72 as shown in FIG. 1, which helps reduce the cost of the fuel supply system. In this example, the high pressure fuel pump 101 is shown securely fixed on the engine cover 73 so that the cam 100 is in forced engagement with the lifter 3. Alternatively, the pump may be mounted on the engine block, for example, in any desired orientation (e. g. upwardly, downwardly, or laterally). Alternatively, the cam 101 may be mounted in the pump body 1, and necessary power therefor may be transmitted from the engine cam shaft via suitable couplings.

In summary, according to the invention, a variable capacity single cylinder plunger pump can be used as the high pressure fuel pump, which makes it possible to cut wasteful work of the pump, and hence fuel cost, as compared with prior art pumps having a fixed capacity.

Since the invention reduces uneven fuel injections into the cylinders, only a minor correction of air-fuel ratio is required by an ECU for stable control of the engine. According to the invention, pulsation of fuel pressure can be minimized and stabilized, which in turn enables precise control of the amount of fuel to be injected as demanded by the engine, thereby providing an optimum condition of combustion for the engine and improving the performance and the fuel economy of the vehicle.

The invention provides means for suppressing the pulsation of fuel pressure in a fuel supply system to permit stable fuel injections. To this end, the fuel supply system is provided with a variable capacity single plunger pump which is suited for the improvement of fuel economy, and with a controller capable of sensing the fuel pressure in the fuel rails for controlling the capacity of the high pressure pump to establish a desired fuel pressure in the fuel rails. As a result, a return-less pipe arrangement may be realized which requires neither a regulator nor a return pipe.

Since the high pressure fuel pump is a single cylinder plunger pump adapted to perform one reciprocal movement for every two fuel injections by the injectors, the frequency of the pump can be reduced, so that the pump can be constructed in a more compact, more cost-less, and more efficient form as compared with conventional one having a fixed capacity.

The drive mechanism of the fuel supply system preferably comprises a rotational drive for rotating a cam at one half the rotational frequency of the engine cam shaft, with the cam having a profile for converting the rotational motion of the rotational drive into the reciprocal movements of the plunger such that each revolution of the cam causes the plunger to reciprocate the number of times which is equal to one half the number of the cylinders.

In a V-6 engine for example, the cam, when mounted on the engine cam shaft, may have three ridges so that one revolution of the cam results in three reciprocal movements of the plunger, resulting in two fuel injections by the injectors per one reciprocal movement of the plunger. The fuel supply system of the invention can be easily applied to V-8 and V-10 engines by providing cams having 4 and 5 cam ridges, respectively.

In addition, two orifices are disposed at inlet parts of the two fuel rails being associated with two arrays of the combustion cylinders and they are connected to the discharge port of the high pressure fuel pump by fuel delivery conduits, and the fuel rails are interconnected with each other at the opposite side ends of the fuel rails to the high pressure fuel pump by a connecting pipe.

Because the orifices each become nodes of the pressure waves in the two fuel rails, they shift the characteristic frequency of the fuel column above the range of normal operating frequency of the engine, thereby eliminating fuel pressure instabilities such as beats and resonance within the frequency range. Furthermore, fuel pressure pulsation may be sufficiently suppressed in the two fuel rails independently by the two orifices.

It should be appreciated that by means of the connecting pipe connecting the downstream ends of the two fuel rails, the difference in the pulsating fuel pressures in the two fuel rails are smoothed out. Accordingly, problematic uneven fuel injections through the separated fuel rails, pertinent to conventional systems, can be avoided.

At a first glance the connecting pipe connecting the two fuel rails seems to double the length of the free fuel column, but it is not the case, since the invention utilizes a variable capacity pump in a returnless pipe configuration, in which practically no fuel flows through the connecting pipe, so that the connecting pipe contributes nothing to the free length of the fuel columns and hence has no influence on the characteristic frequency.

In the manner as described above, the invention not only stabilize and suppress the pulsation of the fuel pressure in the fuel rails, but also smoothes out the difference in fuel pressure between the two fuel rails, thereby minimizing the uneven fuel injections into the respective cylinders.

Thus, the invention provides an improved fuel supply system of an engine equipped with a high pressure fuel pump and adapted not only to stabilize and suppress fluctuating fuel pressures in the fuel rails, but also smooth out the fuel pressures across the fuel rails so as to reduce uneven fuel injections into the cylinders by raising the characteristic frequency of the fuel columns involved.

What is claimed is:

1. A fuel supply system for an engine having a first and a second opposed cylinder arrays each equipped with a fuel injection valve for injecting fuel thereinto, wherein the fuel supply system comprises:

a low pressure pump for transferring fuel from a fuel tank;

a high pressure fuel pump which pressurizes fuel fed from the low pressure pump and comprises a single plunger operating to reciprocate synchronously with the engine;

a first and a second fuel rails provided in association with the first and the second cylinder arrays, respectively;

a pipe line which leads off from the high pressure fuel pump, is diverged to two pipe lines and connected to the first and the second fuel rails; and a first and a second orifices interposed in the pipe line, wherein the high pressure fuel pump has a drive mechanism which comprises a rotational power source rotating at one half the rotational speed of a camshaft of the engine and a cam for converting the rotational power into the reciprocal motion of the plunger, and wherein one rotational motion of the camshaft causes the plunger to reciprocate by one half the number of the combustion cylinders.

2. A fuel supply system for an engine having a first and a second opposed cylinder arrays each equipped with a fuel injection valve for injecting fuel thereinto, wherein the fuel supply system comprises:

a low pressure pump for transferring fuel from a fuel tank;

a high pressure fuel pump which pressurizes fuel fed from the low pressure pump and comprises a single plunger operating to reciprocate synchronously with the engine;

a first and a second fuel rails provided in association with the first and the second cylinder arrays, respectively;

a pipe line which leads off from the high pressure fuel pump, is diverged to two pipe lines and connected to the first and the second fuel rails;

a first and a second orifices interposed in the pipe line; and a connecting pipe for interconnecting the first and the second fuel rails with each other at the opposite side ends of the fuel rails to the high pressure fuel pump.

3. A fuel supply system according to claim 2, wherein the high pressure fuel pump has a drive mechanism which comprises a rotational power source rotating at one half the rotational speed of a camshaft of the engine and a cam for converting the rotational power into the reciprocal motion of the plunger, and wherein one rotational motion of the camshaft causes the plunger to reciprocate by one half the number of the combustion cylinders.

4. A fuel supply system for an engine, comprising:

a low pressure pump for transferring fuel from a fuel tank;

a high pressure single cylinder plunger fuel pump having a variable capacity mechanism, which further pressurizes fuel fed from the low pressure pump and supplies fuel to fuel rails; and fuel injection valves for directly injecting the pressurized fuel stored in the fuel rails into the combustion cylinders of the engine, wherein the number of the fuel rails is two; and the fuel supply system further comprises a mechanism for synchronizing and equalizing phases and amplitudes of the pressure pulsation occurring in the fuel rails.

5. A fuel supply system for an engine having a plurality of fuel injection valves for directly injecting fuel into cylinders of the engine, comprising:

a low pressure pump for transferring fuel from a fuel tank;

a high pressure single cylinder plunger fuel pump, being connected to the discharge side of the low pressure pump and having a variable capacity mechanism, which further pressurizes fuel fed from the low pressure pump;

a first and a second fuel rails which are arranged along the cylinder arrays of the engine and connected to the high pressure fuel pump and fuel injection valves of cylinders of the engine; and a first and a second orifices disposed at inlet parts of the first and the second fuel rails, the inlet parts being connected to the high pressure fuel pump.

6. A fuel supply system according to claim 5, wherein the engine cylinders are arranged to be in straight arrays, and wherein the fuel supply system further comprises:

a fuel pipe which connects the discharge side of the high pressure fuel pump and the first and the second orifices for fuel flow and which is diverged to two pipe lines between the high pressure fuel pump and the orifices; and a controller (ECU) which detects a fuel pressure in the first or the second fuel rail to control the variable capacity mechanism of the high pressure fuel pump thereby regulating the fuel pressure in the fuel rails to a desired level.

* * * * *